US005749678A

United States Patent [19]

Dose et al.

[11] Patent Number: 5,749,678

[45] Date of Patent: May 12, 1998

[54] DEVICE FOR DRIVING A TUNNEL OR DRAIN PIPE

[75] Inventors: Rolf Dose, Filderstadt; Arnold Diehl, Neckartailfingen, both of Germany

[73] Assignee: Putzmeister-Werk Maschinenfabrik GmbH, Aichtal, Germany

[21] Appl. No.: 732,395

[22] PCT Filed: Mar. 25, 1995

[86] PCT No.: PCT/EP95/01137

§ 371 Date: Oct. 25, 1996

§ 102(e) Date: Oct. 25, 1996

[87] PCT Pub. No.: WO95/30065

PCT Pub. Date: Nov. 9, 1995

[30] Foreign Application Priority Data

May 3, 1994 [DE] Germany ..... 44 15 399.6

[51] Int. Cl.[6] ..... F16L 1/00; E03F 3/06

[52] U.S. Cl. ..... 405/184; 405/146; 405/154

[58] Field of Search ..... 405/184, 154, 405/156, 146, 150.1, 151, 141, 138, 143, 144; 175/62, 53, 58; 299/33

[56] References Cited

U.S. PATENT DOCUMENTS

| | | | |
|---|---|---|---|
| 3,915,347 | 10/1975 | Biggart | 222/148 |
| 4,116,011 | 9/1978 | Girault | 405/184 X |
| 4,576,515 | 3/1986 | Morimoto et al. | 405/184 |
| 4,629,255 | 12/1986 | Babendererde | 299/33 |
| 4,818,026 | 4/1989 | Yamazaki et al. | 405/143 X |
| 4,844,656 | 7/1989 | Babendererde et al. | 405/144 |
| 4,846,606 | 7/1989 | Fukada | 405/144 |
| 4,886,396 | 12/1989 | Akesaka | 405/184 |
| 4,915,543 | 4/1990 | Akesaka | 405/154 X |
| 5,123,708 | 6/1992 | Akesaka | 405/143 X |
| 5,203,614 | 4/1993 | Robbins et al. | 405/144 X |

FOREIGN PATENT DOCUMENTS

| | | |
|---|---|---|
| 34 03 890 | 3/1985 | Germany . |
| 35 37 593 | 9/1986 | Germany . |
| 35 37 780 | 1/1987 | Germany . |
| 42 02 060 | 7/1993 | Germany . |
| 43 15 196 | 11/1994 | Germany . |

OTHER PUBLICATIONS

Kainuma, Norio, et al., Entwicklung eines Einpressverfahrens fuer die Verlegung von Starkstromkabeln mit geringen Querschnitten.

Conrad, Eckhard, Funktionsmechnismen und Gestaltungskriterien von Erddruckschilden.

*Primary Examiner*—Dennis L. Taylor

*Attorney, Agent, or Firm*—Flynn, Thiel, Boutell & Tanis, P.C.

[57] ABSTRACT

The invention relates to a device for driving a tunnel or drain pipe along a stretch (14) leading from a starting shaft (10) to a target shaft. The device is primarily intended for making micro or mini-tunnels in which pipe sections (62) are pressed one by one into the drive stretch against a frontal driving head (16). For spoil (32) removal there is a worm conveyor engaging in the cutting chamber (26) of the drive head, to the discharge end of which can be fitted in succession a pressuretightly sealable stone trap (36) and the pressuretightly sealable intake side (42) of a thick matter pump (44), while the pressure side of the thick matter pump (44) is connected to an extendable conveyor line (56) for the spoil.

13 Claims, 5 Drawing Sheets

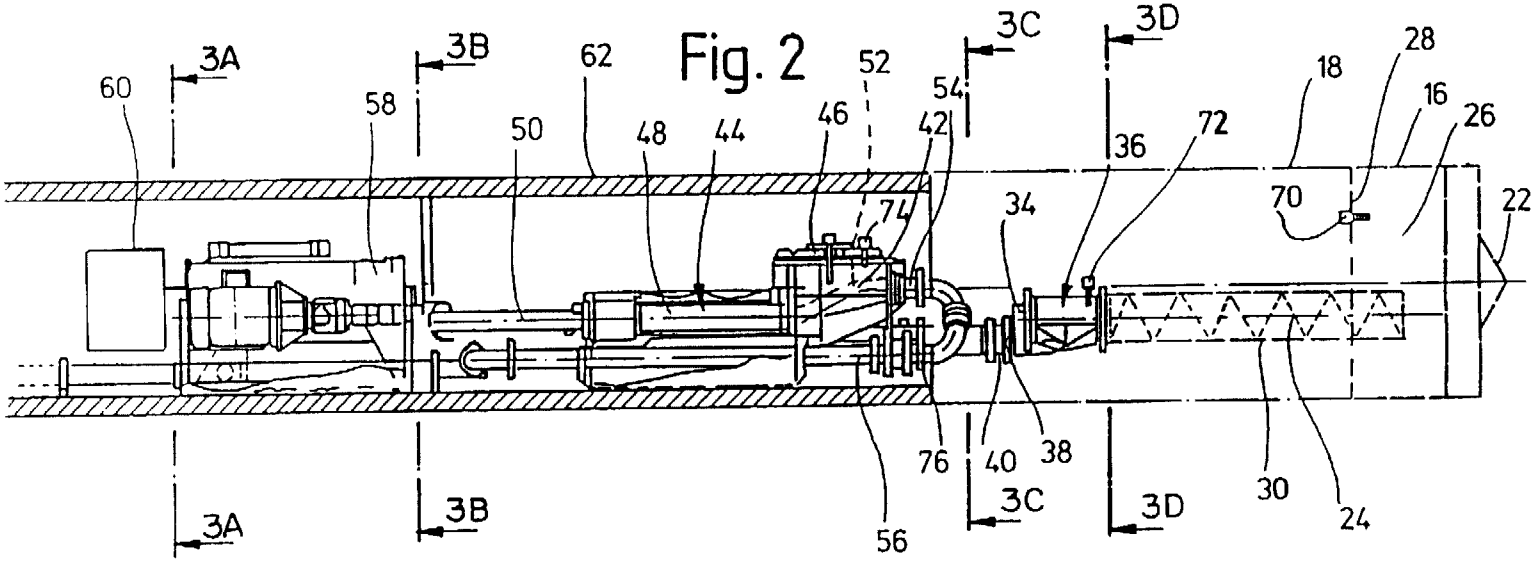
Fig. 2
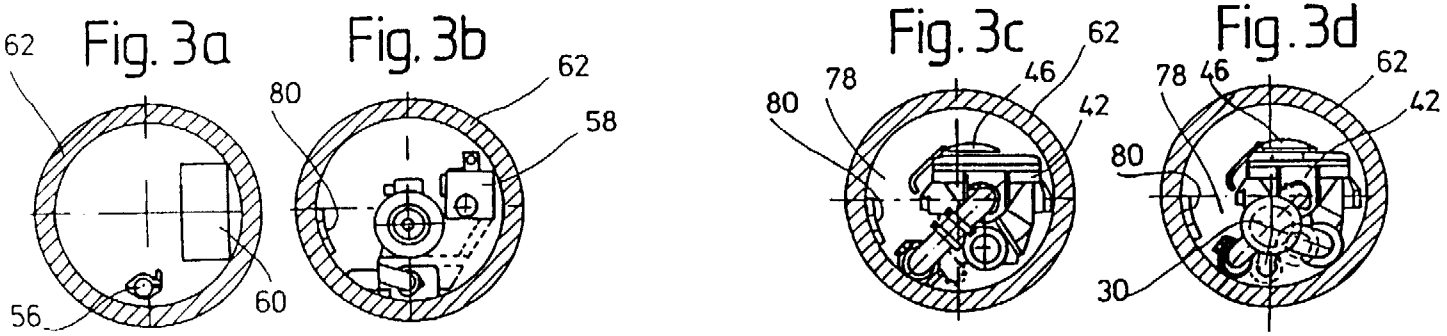
Fig. 3d
Fig. 3c
Fig. 3b
Fig. 3a

DEVICE FOR DRIVING A TUNNEL OR DRAIN PIPE

FIELD OF THE INVENTION

The invention relates to an arrangement for driving a tunnel or drain pipe along a driving stretch leading from a starting shaft to a target shaft, having a driving head, which has a cylindrical shell and a drilling disk, which can be rotated on the front side about the center axis of the shell and can be driven by a motor, a number of pipe pieces, which can be introduced one after the other through the starting shaft into the driving stretch, the first pipe piece of the pipe pieces rests on the front side against the shell of the driving head, a pressing carriage, which can be supported on an abutment within the starting shaft, and presses the pipe pieces axially in a direction toward the driving head, a cutting chamber, which can be loaded with spoil through openings in the drilling disk, and a transporting pipe for the removal of the spoil to a spoil transporting stretch connected to the transporting pipe on the outlet side, which transporting pipe is equipped with a conveyor worm.

BACKGROUND OF THE INVENTION

Arrangements of the above type, which operate according to the pipe pressing method, are often used for the creation of micro tunnels and mini tunnels up to approximately 3 m in diameter and lengths of up to approximately 800 m. A driven driving head is thereby pressed through the earth by the pressing carriage with a constant addition of additional pipe pieces. The accumulating spoil has up to now been conveyed to the outside either by conveyor belts, trolleys or by flush conveying. The removal by belts is relatively complicated if one considers that the belts must be continuously extended as the pipe pieces are moved forward. In addition, one must consider the relatively large amount of space required by a conveyor belt system. The removal by trolleys and rails is simple, however, it is rather time consuming since the driving head can only operate when the trolley is in place. Conveying by flushing is usually used in a gravel-granular type ground, however, it is also in the case of hard stone. The carrier liquid or suspension flows thereby with a high speed through the cutting chamber of the driving head and carries forward with approximately 15% of its circulating volume being spoil. The carrier liquid is separated from the spoil through cyclones, filters, etc. above the ground and is again added into the cycle. This method is expensive, requires large amount of space above-ground and is not suited for all types of grounds. For example, in the case of very soft, fine granular, clay-containing grounds, maintaining the pressure against the earth has been proven to be problematic. Therefore so called earth-pressure shields are used, with which it is important that the advance and the removal of the conveyed material are exactly balanced so that neither a lifting of the ground nor a settling of the ground can occur. This condition can, however, only be maintained when the spoil maintains enough friction compared with the discharge worm so that the pressure against the earth is maintained. This applies indeed to stiff-plastic and plastic type grounds, not, however, to grounds with a soft-plastic or liquid consistency, which cannot build up enough friction through the discharge worm.

Starting out from this the invention suggests to improve an arrangement of the above-disclosed type in such a manner that a spoil rupture can be avoided and the earth pressure in front of the driving head can be maintained constant when used with grounds having a soft-plastic or liquid consistency.

To attain this purpose the combination of characteristics disclosed in claim 1 is suggested. Advantageous embodiments and further developments of the invention result from the dependent claims.

SUMMARY OF THE INVENTION

The solution of the invention is based on the premise of building up a counterpressure on the outlet side of the transporting pipe connected to the cutting chamber of the driving head, which counterpressure enables, even in the case of a soft-plastic spoil, a first pressure maintenance adjusted to the drive advance. In order to achieve this, it is suggested according to the invention that a stone trap, which can be closed off pressure-tight, and the vacuum side of a thick matter pump, which vacuum side can also be closed off pressure-tight, can be connected one after the other to the outlet-side end of the transporting pipe, and that the thick matter pump is connected on the pressure side to a successively extendable conveyor line for the spoil. The pressure-tight design of the spoil transporting stretch up to the vacuum side of the thick matter pump enables at a given forward movement, the adjustment of a counterpressure to the earth pressure, specifically independent of the consistency of the spoil. The thick matter pump can make available additional excess pressure for the removal of the spoil through the conveyor line. The stone trap of the invention in front of the vacuum side of the thick matter pump, which is also hermetically closed off, prevents obstructions, which would be difficult to detect, that can occur along the conveyor line.

A preferred embodiment of the invention provides that the thick matter pump is designed as a hydraulically operable piston pump with one or two conveyor cylinders, the conveyor cylinder or cylinders of which end or ends in a material-feed container, which can be closed off pressure-tight, and into which extends pipe switch connected to the conveyor line and alternately connectable to the conveyor cylinder or the conveyor cylinders.

The thick matter pump is preferably mounted in the pipe piece resting against the driving head. The thick matter pump and its preferably hydraulic driving aggregates can thereby be separated at a cutting point and can be mounted into two adjacent pipe pieces. In order to be able to also travel through curves with the driving head, it is advantageous to connect the transporting pipe of the driving head with an elastically or hingedly flexible compensator to the thick matter pump. The stone trap is thereby advantageously rigidly flanged to the outlet-side end of the transporting pipe, whereas the compensator is arranged between the stone trap and the vacuum side of the thick matter pump.

To monitor the pressure, it is possible to arrange along the spoil transporting stretch at least two pressure sensors extending into the stretch. The earth-pressure monitoring is thereby advantageously done by a pressure sensor extending into the cutting chamber. Two further stone traps can be arranged directly in front of or behind the first stone trap. Upon exceeding a specified pressure drop along the stone trap, the existence of an obstruction can be assumed, which requires an interruption of the drive for the purpose of cleaning the stone trap.

An advantageous development of the invention provides that the stone trap has a screen grid arranged in a pot, which can be closed off pressure-tight with a removable lid, and is connected on the inlet side to the transporting pipe and on the outlet side to the vacuum side of the thick matter pump, and which screen grid holds back solid objects, like stones or root pieces beyond a certain size, which could cause an obstruction of the conveyor line. In order to clean the screen grid, the lid must be removed while the drive is stopped. As an alternative, it is also possible for the stone trap to have a passage channel for the spoil, which passage channel is designed as a cross slide and tapers in a passage direction and/or contains a screen grid. The cross slide is moved in such a manner that the passage channel is accessible from the outside for cleaning purposes.

In order to keep an open space between the thick matter pump and the pipe wall for servicing purposes, the thick matter pump and/or its driving aggregates are, mainly in the case of tunnel pipes with a small diameter, arranged offset on one side with respect to the vertical plane of symmetry of the tunnel pipe. In order to avoid a rolling of the driving head about the longitudinal axis, a counterweight for counterbalancing is, according to an advantageous embodiment of the invention, arranged on the open-space side in the pipe piece.

Since with a varying spoil consistency, the friction in the conveyor line can vary and can at times be very high, it is advantageous to provide a lubricant injector for injecting lubricant into the conveyor line in the vicinity of the pressure outlet of the thick matter pump. A special lubricant, or also mere water, can there by continuously injected into the conveyor line and a lubricant film can be built up between conveying material and an inner wall of the pipe.

BRIEF DESCRIPTION OF THE DRAWINGS

The invention will be discussed in greater detail hereinafter in connection with one exemplary embodiment schematically illustrated in the drawings, in which:

FIG. 2 is a side view of the driving machine according to FIG. 1;

FIGS. 3*a*, 3*b*, 3*c*, and 3*d* are cross-sectional views along the cross-sectional lines 3A—3A, 3B—3B, 3C—3C and 3D—3D of FIG. 2;

DETAILED DESCRIPTION

Figure 1:
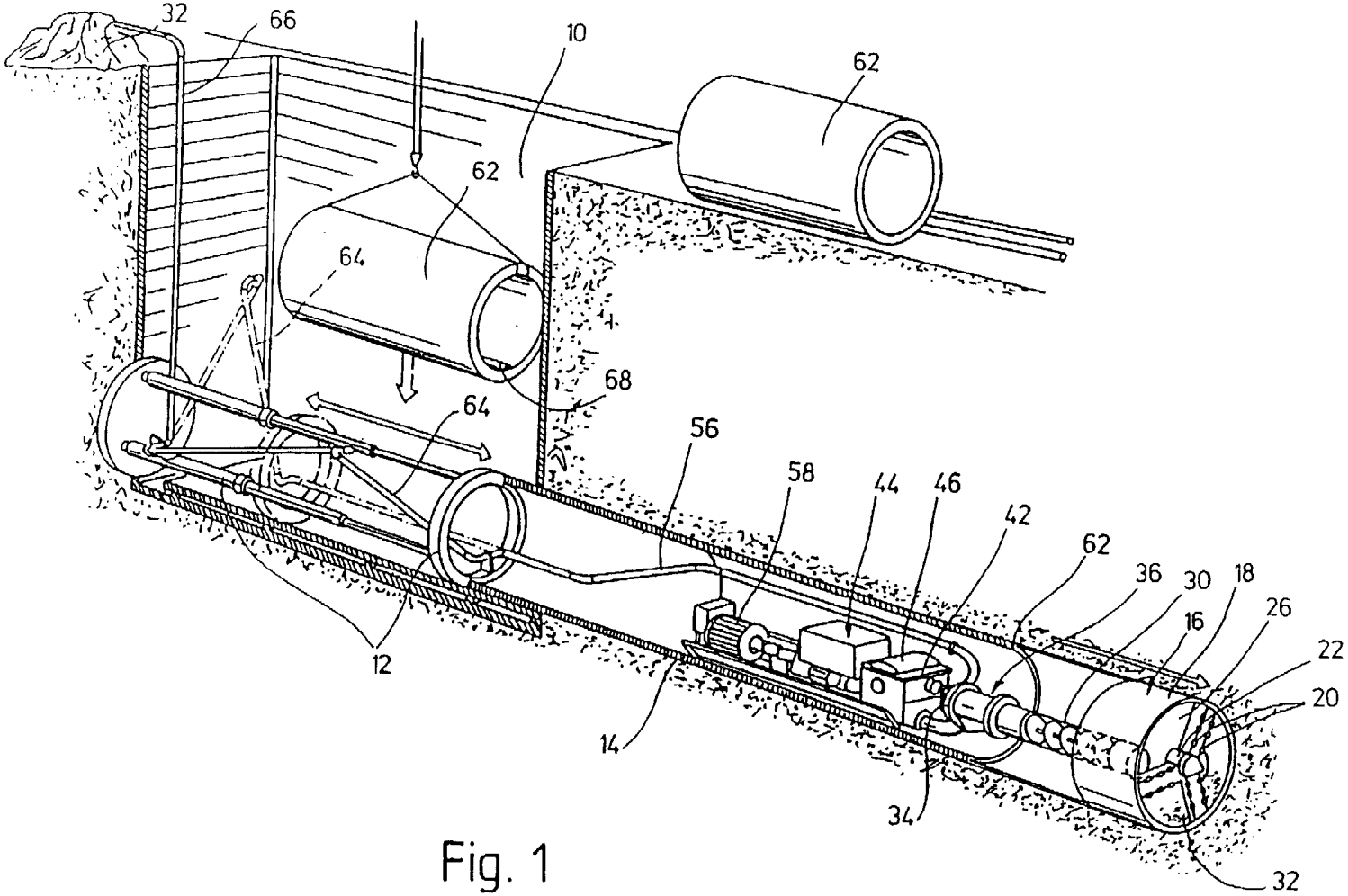
FIG. 1 is a diagrammatic illustration of a tunnel-driving machine operating for use with the pipe-pressing method.
Figure 4:
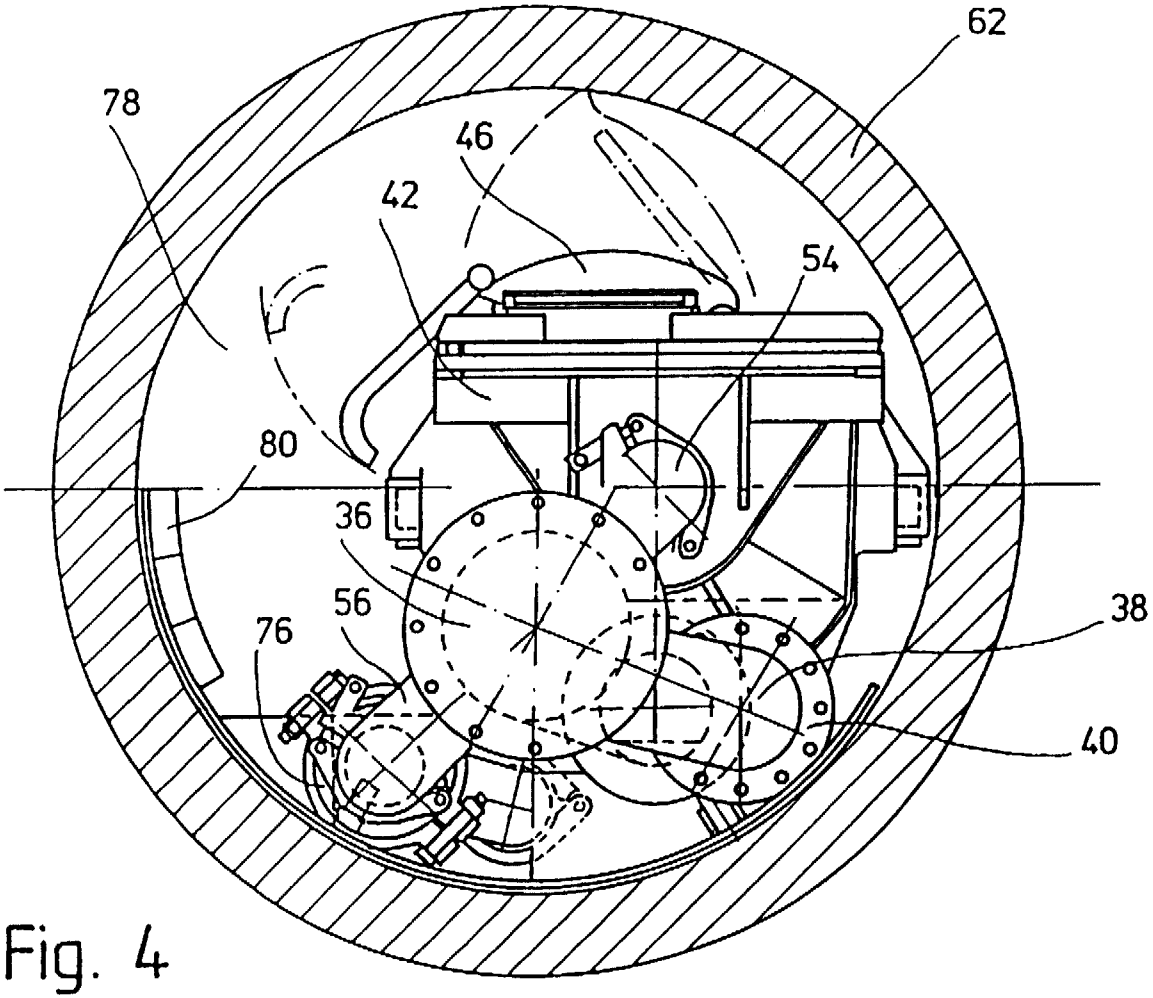
FIG. 4 is an enlarged illustration of FIG. 3*d*.

The tunnel-driving machine illustrated in the drawings is designated for the creation of micro or mini tunnels, in which tunnel or drain pipes are moved in a pipe-pressing method from a starting shaft 10 with the help of a hydraulically operable pressing carriage 12 into a driving stretch 14.

The driving head 16 consists essentially of a cylindrical shell 18, a motor-driven drilling disk 22, which has cutting teeth 20 and defines the shell on the front side, and a transporting pipe 30 for the spoil 32 accumulating in the cutting chamber 26. The transporting pipe has a motor-driven conveyor worm 24, extends on the inlet side into the cutting chamber 26 of the driving head 16, and extends rearwardly through the partition wall 28 of the cutting chamber. A stone trap 36, which can be closed off pressure-tight by means of a lid 34, is connectedly flanged to the outlet-side end of the transporting pipe 30. The outlet connection 38 of the stone trap is connected through a flexible compensator 40 to the vacuum chamber of a two-cylinder thick matter pump 44, which vacuum chamber is provided in a material-feed container 42. The material-feed container 42 can be closed off pressure-tight with the help of a lid 46. The conveyor cylinders 48 of the thick matter pump 44 end on their front side in the material-feed container 42. Their pistons can be moved hydraulically in a push-pull operation with the help of the hydraulic cylinders 50. Within the material-feed container 42, there is provided an S-shaped curved pipe switch 52, the inlet-side opening of which is swung alternately in front of the cylinder openings of the conveyor cylinders 48, and the outlet-side end 54 of which is connected through a pipe-twisting connection to an outwardly leading conveyor line 56. The thick matter pump 44 is controlled through a hydraulic aggregate 58 and an electric control unit 60.

Figure 5A:
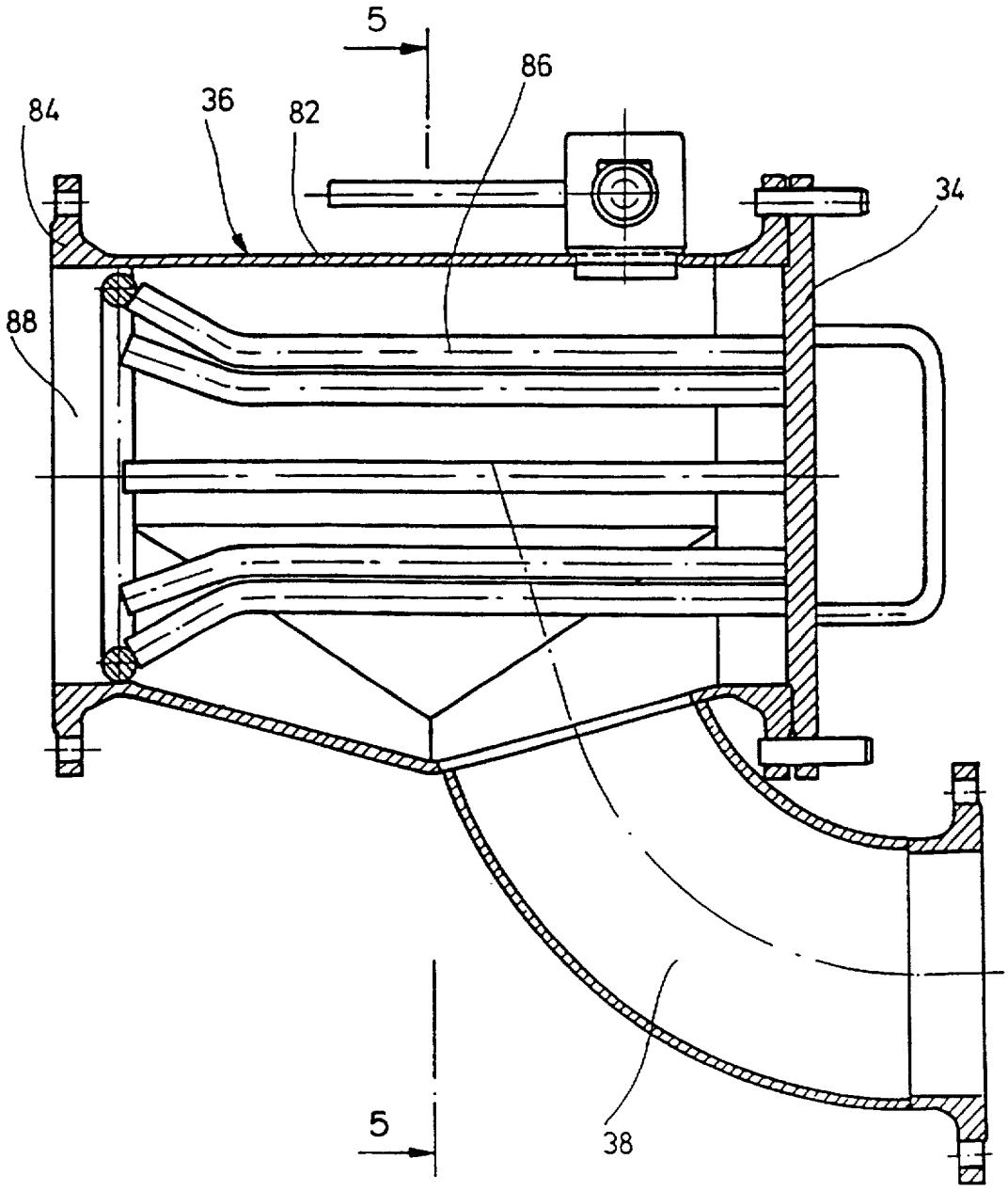
FIGS. 5*a* and *b* are a longitudinal cross-sectional view of the stone trap according to FIG. 2 and a cross-sectional view along the cross-sectional line 5—5 of FIG. 5*a*.
Figure 5B:
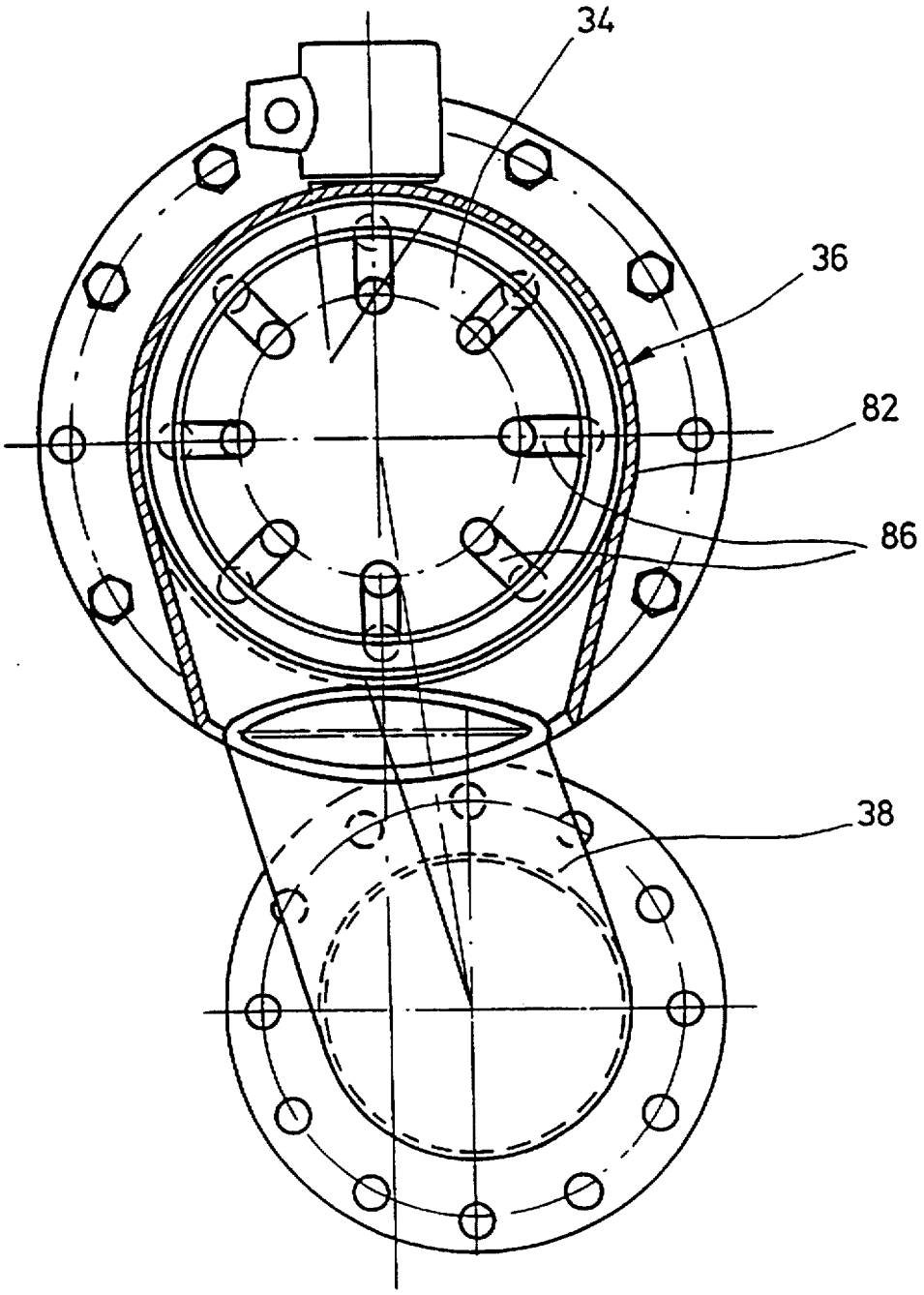

The stone trap 36 shown in FIGS. 5*a* and *b* consists essentially of a cylindrical pot 82 with an inlet-side flange connection 84 for connection to the transporting pipe 30 and an outlet-side outlet connection 38 branching off one of the sides. A screen grid 86, which is closed off on the rear side by the lid 34, is rigidly connected to same, and is open on the front side funnel-like toward the flange-side inlet opening 88. This arrangement guarantees that only the spoil, which fits through the screen grid 86, is forwarded to the thick matter pump 44 for removal. Larger pieces arriving with the spoil 32 collect in the screen grid 86 and can be removed from the stone trap 36 by removing the lid 34 together with the screen grid 86.

The starting shaft 10 is created by digging downward at the beginning of the tunnel operations, and the pressing carriage 12 is moved into position within the starting shaft. The driving head 16 is then moved with the help of the pressing carriage 12 a distance into the driving stretch and the accumulating spoil is removed from the starting shaft. The pipe pieces 62 are then one after the other lowered into the starting shaft 10 and are pressed by the pressing carriage into the driving stretch 14. The thick matter pump 44 is mounted in the first pipe piece 62 behind the driving head 16, which thick matter pump is connected to the transporting pipe 30 through the stone trap 36. The conveyor line 56, which branches off from the pressure side of the thick matter pump 44, guides spoil outwardly through a two-arm articulated pipe 64 and the vertical line piece 66 through the starting shaft 10. With each pipe piece 62, a further line section 68 is introduced into the starting shaft 10 and is coupled into the conveyor line 56. The machine is then advanced by the pressing carriage 12 step-by-step through each pipe-piece length. The pressure in the cutting chamber 26 of the driving head 16, at the inlet of the stone trap 36 and within the vacuum chamber 42 is measured and monitored during the advance by suitably positioned sensors 70, 72, 74. In order to avoid blockage within the thick matter pump 44 and the conveyor line 56, oversized stones, roots, and other contaminants, which could exist in the ground, are caught with the help for the stone trap 36. By continuously measuring the earth pressure of the spoil with the pressure sensors 72, 74 in front of and behind the stone trap 36, it is guaranteed that an obstruction is immediately detected and can be subsequently removed. The stone trap can for this purpose be easily opened at its lid 34 and can be cleaned. This can be done either automatically or manually.

Since with a varying ground consistency, the frictional resistance in the conveyor line 56 can also vary and can at times be very high, an injection ring nozzle 76 is provided at the inlet of the conveyor line 56, through the nozzle a lubricant or water can be injected into the conveyor line.

Since both the thick matter pump 44 and the hydraulic aggregate 58 must be accessible for repair purposes, they are arranged in a pipe piece on one side with respect to the tunnel vertical axis leaving an open space 78. Counterweights 80 additionally mounted in the respective pipe piece 62 counterbalance the pipe piece to prevent a rolling of the driving head 16.

In conclusion the following is to be stated. The invention relates to an arrangement for driving a tunnel or drain pipe along a driving stretch 14 leading from a starting shaft 10 to a target shaft. The arrangement is mainly designated for the creation of micro tunnels or mini tunnels, in which the pipe pieces 62 are one after the other pressed into the driving stretch against a driving head 16 arranged on the front side. For the removal of the spoil 32, a conveyor worm engaging the cutting chamber 26 of the driving head is provided forcing spoil to the outlet-side end connected serially to a stone trap 36, which can be closed off pressure-tight, and then to the vacuum side 42 of a thick matter pump 44, which vacuum side can be closed off pressure-tight, whereas the thick matter pump 44 is connected on the pressure side to a successively extendable conveyor line 56 for transporting the spoil.

The embodiments of the invention in which an exclusive property or privilege is claimed are defined as follows:

1. An arrangement for driving a tunnel or drain pipe along a driving stretch leading from a starting shaft to a target shaft, comprising a driving head, which has a cylindrical shell and a drilling disk, which can be rotated on the front side about a center axis of the shell and can be driven by a motor, a number of pipe pieces, which can be introduced one after the other through the starting shaft into the driving stretch, a first pipe piece of the pipe pieces rests axially against the shell of the driving head, a pressing carriage, which can be supported on an abutment within the starting shaft, presses the pipe pieces axially in the direction of the driving stretch, a cutting chamber, which can be loaded with around spoil through openings in the drilling disk, a transporting pipe for the removal of the spoil from the cutting chamber to a spoil transporting stretch connected to an outlet end of the transporting pipe which transporting pipe is equipped with a conveyor worm or a pair of conveyor-worms, and a stone trap, which can be closed off pressure-tight, and a vacuum side of a thick matter pump, which vacuum side can be closed off pressure-tight, can be connected one after the other to the outlet end of the transporting pipe, the thick matter pump being connected on the pressure side to a successively extendable conveyor line for the spoil, the thick matter pump being a hydraulically operatable piston pump with one or two conveyor cylinders, the conveyor cylinder or cylinders respectively end or ends in a material-feed container, which can be closed off pressure-tight, and into which extends a pipe switch connected to the conveyor line and alternately connectable to one conveyor cylinder or the conveyor cylinders.

2. The arrangement according to claim 1, wherein the thick matter pump is mounted into the first pipe piece resting against the driving head.

3. The arrangement according to claim 1, wherein the thick matter pump and its preferably hydraulic driving aggregates are separatable at a cutting point and can be mounted into two adjacent pipe pieces.

4. The arrangement according to claim 1, further comprising at least two pressure sensors arranged along the spoil transporting stretch and extending into said stretch.

5. The arrangement according to claim 4, wherein one pressure sensor is arranged directly in front of or behind the stone trap.

6. The arrangement according to claim 1, further comprising a pressure sensor extending into the cutting chamber.

7. The arrangement according to claim 1, further comprising at least one pressure sensor extending into the conveyor line.

8. The arrangement according to claim 1, wherein the stone trap has a screen grid arranged in a pot, which can be closed off pressure-tight with a removable lid, and is connected on the inlet side to the transporting pipe and on the outlet side to the vacuum side of the thick matter pump.

9. The arrangement according to claim 1, wherein the stone trap has a passage channel for the spoil, which passage channel is designed as a cross slide, tapers in passage direction and/or contains a screen grid.

10. The arrangement according to claim 1, wherein the thick matter pump and/or its driving aggregates are mounted laterally offset, leaving an open space with respect to the vertical axis of the respective pipe piece, and wherein a counterweight is arranged on the open-space side of the pipe piece.

11. The arrangement according to claim 1, wherein between the stone trap and the vacuum side of the thick matter pump there is arranged an elastically flexible compensator.

12. The arrangement according to claim 1, further comprising a lubricant injector, preferably designed as a slide ring nozzle, is arranged in the conveyor line.

13. The arrangement according to claim 1, wherein the pressing carriage carries an articulated pipe connectable to the conveyor line.

* * * * *